US006783224B2

(12) United States Patent
Adachi et al.

(10) Patent No.: US 6,783,224 B2
(45) Date of Patent: Aug. 31, 2004

(54) INK-JET PRINTING APPARATUS

(75) Inventors: Koichi Adachi, Shimizu (JP); Minoru Koyata, Mishima (JP); Hidehiro Watanabe, Tokyo (JP); Atsushi Kubota, Sunto-gun (JP)

(73) Assignee: Toshiba Tec Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/404,042

(22) Filed: Apr. 2, 2003

(65) Prior Publication Data

US 2004/0100543 A1 May 27, 2004

(30) Foreign Application Priority Data

Nov. 26, 2002 (JP) ..... 2002-342668

(51) Int. Cl.[7] ..... B41J 2/01
(52) U.S. Cl. ..... 347/100; 347/101; 347/95
(58) Field of Search ..... 347/100, 96, 95, 347/101, 102; 106/31.13, 31.27, 31.6

(56) References Cited

U.S. PATENT DOCUMENTS 5,570,118 A * 10/1996 Rezanka et al. ..... 347/100
5,963,230 A 10/1999 Higashino et al.
6,084,610 A 7/2000 Ozaki et al.
6,342,095 B1 * 1/2002 Takizawa et al. ..... 106/31.27
6,508,552 B1 * 1/2003 Steinfield et al. ..... 347/102

FOREIGN PATENT DOCUMENTS

JP 06143795 A * 5/1994 ..... B41M/5/00
JP 8-216392 8/1996

OTHER PUBLICATIONS

Patent Abstracts of Japan, JP 06–143795, May 24, 1994.

* cited by examiner

*Primary Examiner*—Stephen D. Meier
*Assistant Examiner*—Manish Shah
(74) *Attorney, Agent, or Firm*—Oblon, Spivak, McClelland, Maier & Neustadt, P.C.

(57) ABSTRACT

At least two or more than two ink-jet recording heads provided with respective discharge ports for discharging ink are arranged in the direction of conveyance of recording medium. The inks filled in the respective ink-jet recording heads are made to show different surface tensions. With this arrangement, as inks are discharged onto the recording medium that is conveyed by a conveyor under the control of a drive section, the image formed by the inks discharged onto the recording medium shows an improved quality.

10 Claims, 3 Drawing Sheets

INK-JET PRINTING APPARATUS

CROSS-REFERENCE TO THE RELATED APPLICATIONS

This application is based upon and claims the benefit of priority from the prior Japanese Patent Application No. 2002-342668, filed Nov. 26, 2002, the entire contents of which are incorporated herein by reference.

BACKGROUND OF THE INVENTION

1. Field of the Invention

The present invention relates to an ink-jet printing apparatus that can stabilize the image quality.

2. Description of the Related Art

Ink-jet printing apparatus adapted to prevent feathering and blurring among different colors from taking place are known (see, inter alia, Jpn. Pat. Appln. KOKAI Publication No. 8-216392).

With known printing apparatus comprising a plurality of discharge units, UV inks or solvent inks that are regulated so as to show a constant level of surface tension are discharged from the discharge units to form an image. Then, the discharged inks are fixed to the medium by means of a UV-setting device or a drier in a subsequent step.

With known printing apparatus, the inks discharged from the respective discharge units produce ink dots with different diameters, which are then fixed to the medium. However, a high quality image cannot be formed by ink dots having different diameters. Particularly, the time spent for the ink droplet discharged from the leading discharge unit to get to the fixing unit and the time spent for the ink droplet discharged from the tail end discharge unit to get to the fixing unit show the largest difference. This difference results in a remarkable difference of dot diameters and a poor image quality.

If the surface tension is differentiated among inks to dissolve the above problem, adjacently located inks can give rise to bleeding, which by turn produces a poor image quality. Therefore, there is a difficult problem of tradeoff.

BRIEF SUMMARY OF THE INVENTION

An object of the present invention is to provide an ink-jet printing apparatus that can produce high quality images.

According to an aspect of the invention, there is provided an ink-jet printing apparatus comprising: at least two or more than two ink-jet heads provided with respective discharge ports for discharging ink and arranged in the direction of conveyance of recording medium; a conveyor for conveying a recording medium; and a drive section for driving the ink-jet heads so as to discharge inks toward the recording medium being conveyed by the conveyor;

the inks discharged form the respective ink-jet heads being made to show different surface tensions.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate presently preferred embodiments of the invention, and together with the general description given above and the detailed description of the preferred embodiments given below, serve to explain the principles of the invention.

DETAILED DESCRIPTION OF THE INVENTION

Figure 1:
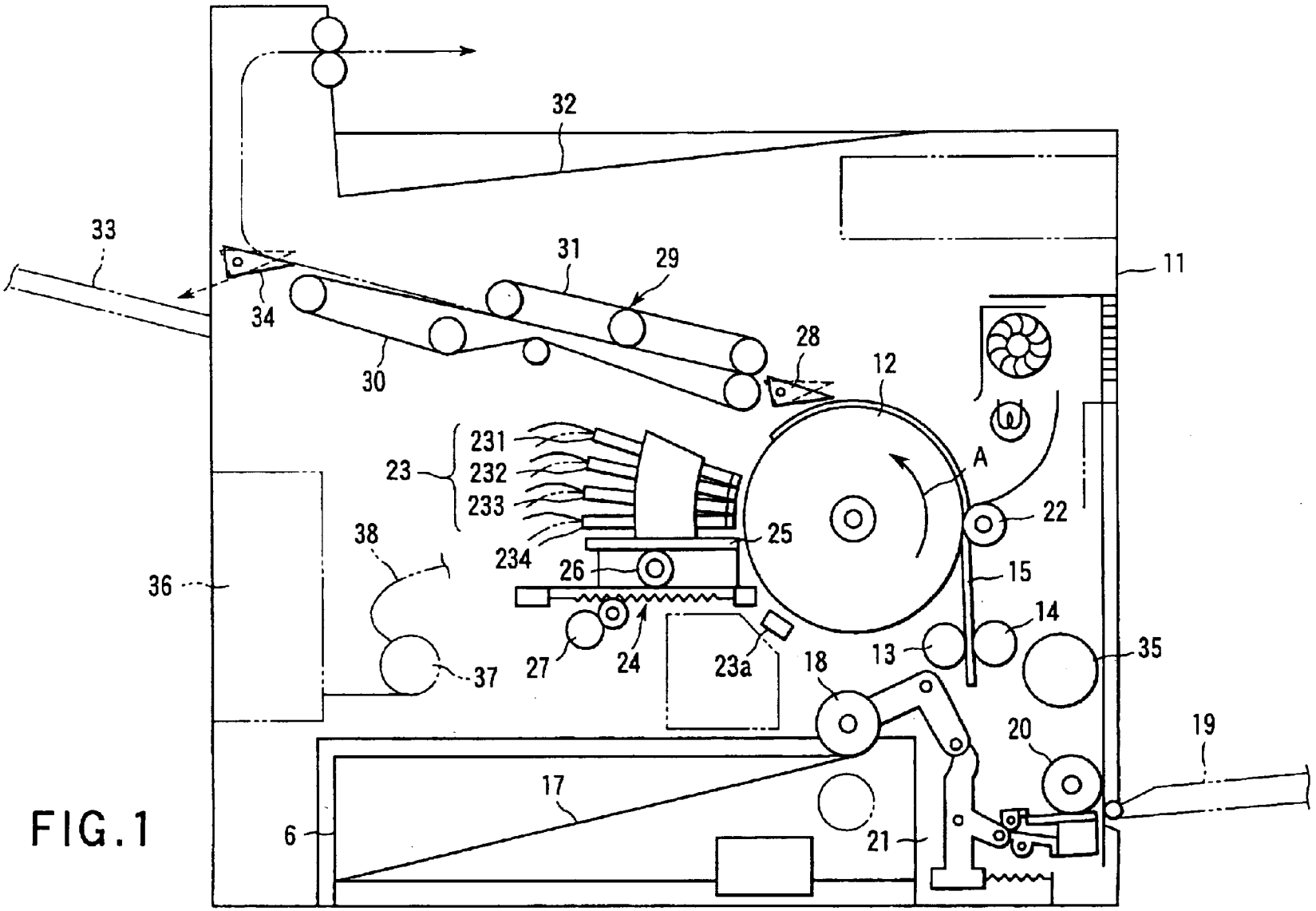
FIG. 1 is a schematic view showing the configuration of an ink-jet printing apparatus according to the invention, which commonly illustrates the first and second embodiment of the invention.

Now, the first embodiment of the present invention will be described with reference to the drawing.

FIG. 1 is a schematic view showing the mechanical configuration of an ink-jet printing apparatus according to the invention. In FIG. 1, reference symbol 11 denotes a main body case. A drum 12 is arranged in the main body case 11 and adapted to rotate at a constant peripheral speed in the direction indicated by an arrow in FIG. 1. A recording medium 15, which may be a sheet of recording paper fed by way of a pair of paper feeding rollers 13, 14, is wound around the drum 12.

A sheet feeding cassette 6 is arranged at the bottom of the main body case 11. A recording medium 15 arranged on table plate 17 of the sheet feeding cassette 6 are taken out one by one by a feed roller 18 and fed to the paper feeding rollers 13, 14. The recording medium 15 manually fed from a manual feed tray arranged at a lateral side of the main body 11 so as to be freely opened and closed may also be conveyed to the paper feeding rollers 13, 14 by way of a feed roller 20. The feed roller 18 and the feed roller 20 are selectively used for feeding a recording medium by means of a feed switching means 21.

A charging roller 22 is arranged opposite to the drum 12 in order to cause the recording medium 15 fed from the paper feeding rollers 13, 14 to be adsorbed by the drum surface. Additionally, four ink-jet recording heads 231, 232, 233, 234, each comprising a large number of linearly disposed recording elements are also arranged opposite to the drum 12. The four ink-jet recording heads 231, 232, 233, 234 may be referred to collectively as ink-jet recording head 23 hereinafter. The ink-jet recording heads 231, 232, 233, 234 are incorporated in the printing mechanism 24 so as to be movable in the direction of the rotary shaft of the drum 12 in which the recording elements are disposed.

Thus, the recording medium 15 is conveyed by the revolving drum 12 in a direction substantially perpendicular to the direction in which the recording elements of the ink-jet recording heads 231 through 234 are disposed.

The ink-jet recording heads 231 through 234 are filled respectively with cyan, magenta, yellow and black UV (ultraviolet-set type) inks that are set by an electromagnetic wave.

More specifically, the recording head 231 discharges cyan (C) ink and the recording head 232 discharges magenta (M) ink, while the recording head 233 discharges yellow (Y) ink and the recording head 234 discharges black (B) ink. The recording head 231, the recording head 232, the recording head 233 and the recording head 234 are arranged in parallel with each other in the mentioned order from the upstream side of the conveyance route of the recording medium 15 that is wound around the drum 12 and conveyed. They are separated from each other with predetermined gaps.

Each of the ink-jet recording heads 231 through 234 is provided with a large number of ink discharge ports that are arranged at a predetermined pitch and adapted to operate as so many recording elements.

The printing mechanism 24 comprises a reciprocating mechanism 25 carrying the ink-jet recording heads 231 through 234, a motor unit 26 including a reciprocating rod and a linear motor and an advancing/retreating means 27. The ink-jet recording heads 231 through 234 are driven to advance forward or retreat from the peripheral surface of the drum 12 by the advancing/retreating means 27. The reciprocating mechanism 25 is moved under control in the direction of the rotary shaft of the drum 12 by the motor unit 26 in order to reciprocate the ink-jet recording heads 231 through 234 in the direction of the rotary shaft, or the direction of the line of the recording medium 15.

A UV (ultraviolet rays) setting unit 23*a* is arranged downstream relative to the ink-jet recording head 23 as viewed in the direction A of revolution of the drum and adapted to operate as ink fixing unit. The UV-setting unit 23*a* sets the inks discharged onto the recording medium 15 and fixes the inks to the recording medium 15.

The drum 12 is provided with a peeling claw 28 that can be inserted between the peripheral surface of the drum 12 and the recording medium 15. The recording medium 15 peeled by the peeling claw 28 is delivered to a recording medium discharge/delivery mechanism 29. The recording medium discharge/delivery mechanism 29 comprises a belt conveyor 30 held in contact with the non-recording surface of the recording medium 15 and a push/press means 31 for pushing/pressing the recording medium 15 against the corresponding surface of the belt conveyer 30.

A direction switcher 34 is arranged at the downstream end of the belt conveyor 30 and adapted to selectively deliver the recording medium 15 conveyed by the belt conveyor 30 either onto an upper delivery tray 32 arranged in an upper part of the main body case 11 or onto a delivery tray 33 removably fitted to a lateral side of the main body case 11.

The main body case 11 contains in the inside thereof a main motor 35 for driving various parts to rotate, an ink cassette 36 for supplying inks, an ink buffer 37 for temporarily storing the inks supplied from the ink cassette 36 and an ink supply tube 38 for supplying inks from the ink buffer 37 to the respective ink-jet recording heads 231 through 234.

With the embodiment of color ink-jet recording apparatus having the above described configuration, a recording medium 15 is typically taken out from the sheet feeding cassette 6 by means of the feed roller 18 and sent to the paper feeding rollers 13, 14 for a recording operation. The paper feeding rollers 13, 14 feed the recording medium 15 to the revolving the revolving drum 12. Then, the recording medium 15 is adsorbed by and wound around the surface of the charging roller 22.

As the drum 12 revolves, the recording medium 1 is driven to move in the direction of arrangement of the ink-jet recording heads 231 through 234. Then, inks of different colors are selectively discharged from the ink discharge ports of the ink-jet recording heads 231 through 234 at predetermined timings according to the image signal and fixed by the UV-setting unit 23*a* imaging recording.

Figure 2:
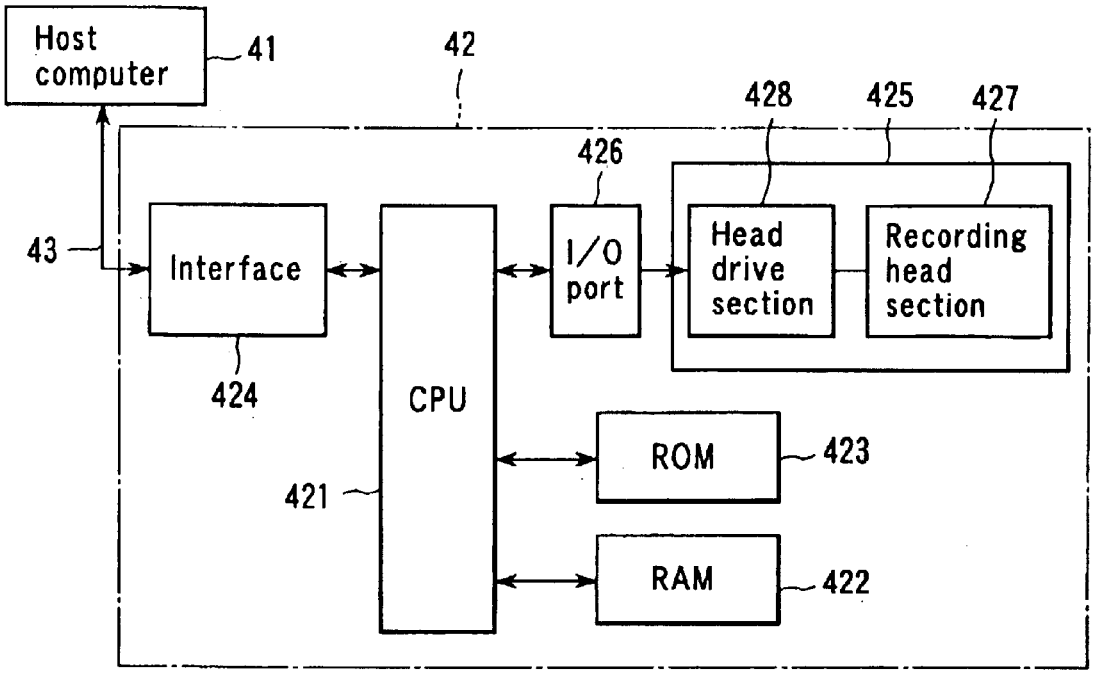
FIG. 2 is a block diagram showing the configuration of the control system of the first and second embodiments.

FIG. 2 is a block diagram showing the configuration of the control system of the first embodiment. Referring to FIG. 2, host computer 41 and the color ink-jet recording apparatus 42 are connected by a cable 43 so that color image signals are transmitted from the host computer 41 to the color ink-jet recording apparatus 42.

The color ink-jet recording apparatus 42 comprises a CPU (central processing unit) 421 that is the main body of the control section of the apparatus. A RAM (random access memory) 422 that includes a work memory to be used by the CPU 421 for processing operations and a temporary storage memory for temporarily storing an image signal. A ROM (read-only memory) 423 for storing program data to be used by the CPU 421 for controlling various components. An interface 424 to be used for transmitting data to and receiving data from the host computer 41. An I/O port 426 connected to the printing mechanism section 425.

The printing mechanism section 425 includes a recording head section 427 having the ink-jet recording heads 231 through 234 and a head drive section 428 for driving the ink-jet recording heads 231 through 234 of the recording head section 427. It may be needless to say that the printing mechanism section 425 also includes the above described printing mechanism 24.

The CPU 421 controls the printing mechanism section 425 for printing operations. More specifically, as the CPU 421 takes in a color image signal from the host computer 41, it stores the image signal in the RAM 422 and then performs an image processing operation on the signal, which is subsequently supplied to the printing mechanism section 425 to cause the section 425 to operate for color image recording.

Figure 3:
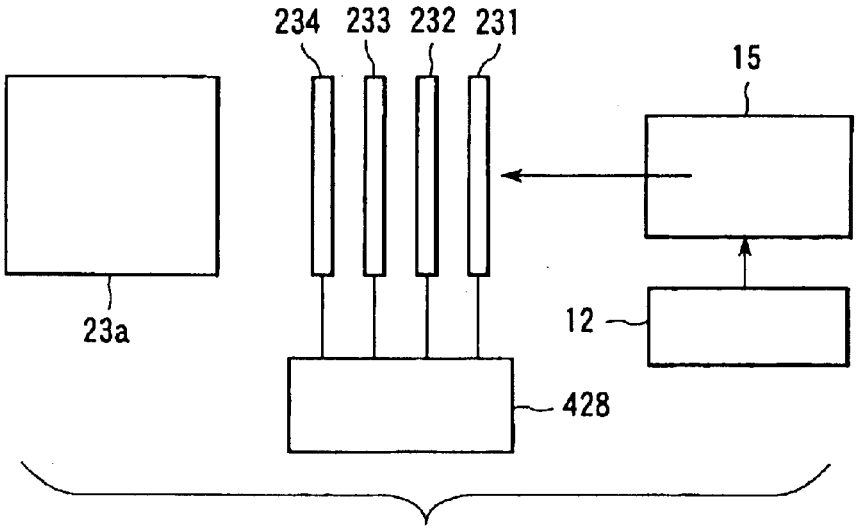
FIG. 3 is a block diagram showing a principal part of the first embodiment of ink-jet printing apparatus according to the invention.

Now, the present invention will be described with reference to FIG. 3 that illustrates essential components of the embodiment as extracted from FIG. 1.

The applicant of the present invention looked into the printing quality by filling the ink-jet recording heads 231 through 234 with black inks 1 through 4 showing different surface tensions.

More specifically, inks 1 through 4 showing different surface tensions were prepared by adding a surface tension regulating agent to a black pigment, an acryl monomer, a photo-polymerization initiator and an organic polymer disperser. The surface tensions of inks 1 through 4 were differentiated so as to fall in the descending order by adding the surface tension regulating agent to different respective ratios.

Then, inks 1 through 4 were discharged respectively from the ink-jet recording heads 231 through 234 to the recording medium 15 for printing. Subsequently, the dots formed by the inks discharged from the ink-jet recording heads 231 through 234 were observed for bleeding and evaluated. Table 1 summarily shows the outcome of evaluation.

In Table 1, bleeding was evaluated by the difference between the maximum value and the minimum value of surface tension. It was rated as good (o) when the difference is not greater than 2, as slightly bad (Δ) when the difference is 3 and as bad (x) when the difference is not smaller than 4.

TABLE 1

| Difference of ink surface tension (mN/m) | Bleeding |
|---|---|
| 0 | ○ |
| 2 | ○ |
| 3 | Δ |
| 4 | x |

Figure 4:
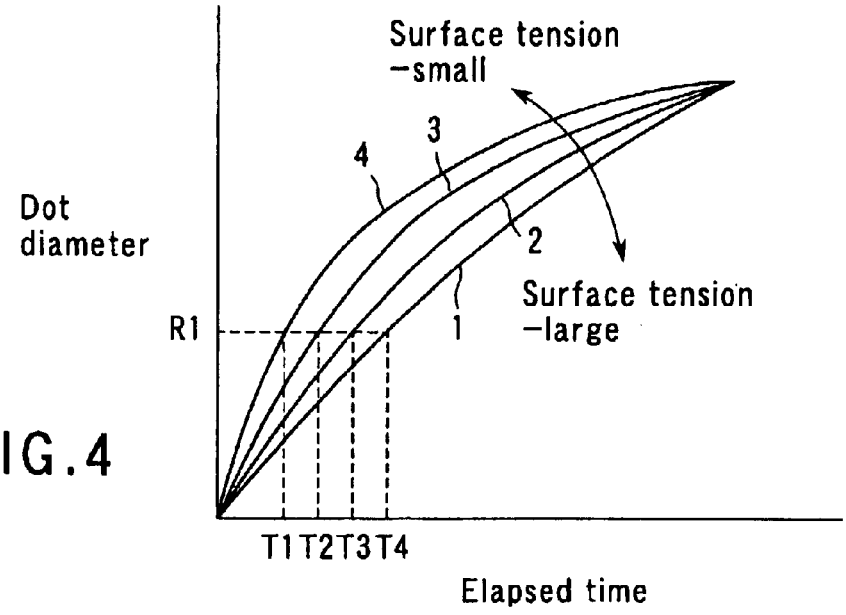
FIG. 4 is a graph illustrating the relationship between the elapsed time and the dot diameter of the first embodiment.
Figure 5A:
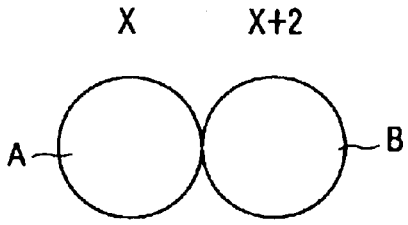
FIGS. 5A and 5B schematically illustrate ink dots formed by using inks having different surface tensions.
Figure 5B:
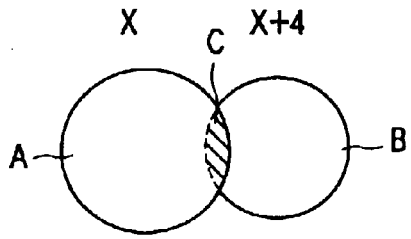

In FIG. 4, the time periods from the time when inks are discharged from the ink-jet recording heads 231 through 234 to the time when they get to the UV-setting unit 23*a* are expressed respectively by T4 through T1 (T4>T3>T2>T1). In order to make the ink dots getting to the UW-setting unit 23*a* to show the same and identical diameter of R1, the surface tensions of inks 1 through 4 needs to be such as those indicated by curves 1 through 4. The surface tensions of inks 1 through 4 falls in the mentioned order.

Thus, when the surface tensions of inks discharged respectively from the ink-jet recording heads 231 through 234 are differentiated so as to fall in the mentioned order and the difference between the maximum value and the minimum value of the surface tension of the ink is made not greater than 3 mN/m, preferably not greater than 2 mN/m, the dots of the fixed inks can be made substantially equal to each other if the time periods from the time when inks are discharged from the ink-jet recording heads 231 through 234 to the time when they get to the UV-setting unit 23*a* fall in the mentioned order. Additionally, the adjacently located ink dots do not show any bleeding so that the image quality of the produced image is stabilized.

In other words, when the surface tension of dot A is X and that of dot B located adjacent to dot A is X+2, the difference of surface tension is not greater than 2 mN/m so that the dots A and B can be made to show the same diameter.

However, when the surface tension of dot A is X and that of dot B located adjacent to dot A is X+4, the difference of surface tension is greater than 3 mN/m so that the diameter of the dot A becomes greater than that of the dot B and bleeding takes place at the overlapping area C.

The ink-jet recording heads 231 through 234 were filled with black inks showing different surface tensions that fell in the descending order in the above described experiment. When the ink-jet recording heads 231 through 234 are filled respectively with cyan, magenta yellow, and black inks, the surface tensions of the inks should be differentiated so as to fall in the descending order.

It is not necessary to discriminate the colors of inks that are filled respectively into the ink-jet recording heads 231 through 234 when the surface tensions of inks are low.

Figure 6:
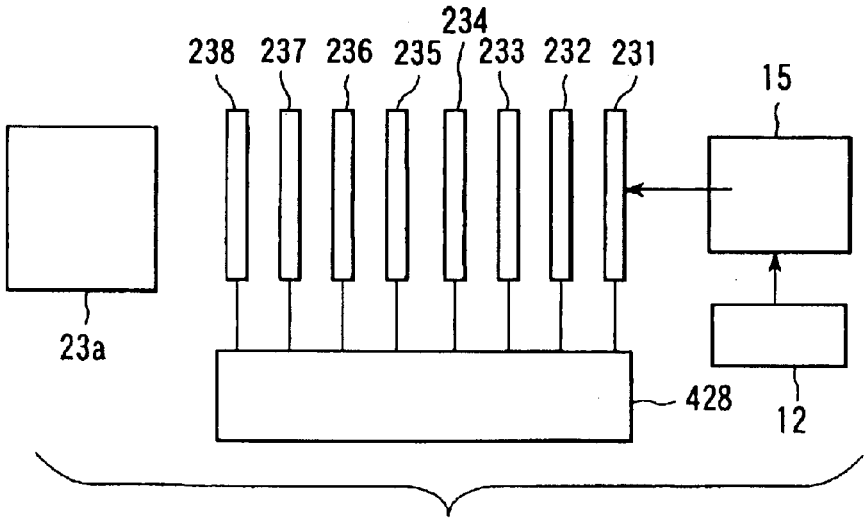
FIG. 6 is a block diagram showing a principal part of the second embodiment of ink-jet printing apparatus according to the invention.

Now, the second embodiment of the invention will be described with reference to FIG. 6. FIG. 6 also illustrates essential components of the embodiment as extracted from FIG. 1. The second embodiment comprises eight ink-jet recording heads 231 through 238, which may also be referred to collectively as ink-jet recording head 23.

The ink-jet recording heads 231 through 238 are arranged in the direction of conveyance of the recording medium 15 at regular intervals in the mentioned order.

The applicant of the present invention looked into the printing quality by filling the ink-jet recording heads 231 through 234 with black inks 1 through 4 showing different surface tensions and the ink-jet recording heads 235 through 238 with yellow inks 5 through 8 showing different surface tensions.

More specifically, in an experiment, inks 1 through 4 showing different surface tensions were prepared by adding a surface tension regulating agent to a black pigment, an acryl monomer, a photo-polymerization initiator and an organic polymer disperser.

Additionally, inks 5 through 8 showing different surface tensions were prepared by adding a surface tension regulating agent to a yellow pigment, an acryl monomer, a photo-polymerization initiator and an organic polymer disperser. The surface tensions of inks 1 through 8 were differentiated so as to fall in the descending order by adding the surface tension regulating agent to different respective ratios.

Then, inks 1 through 8 were discharged respectively from the ink-jet recording heads 231 through 238 for printing. Subsequently, the dots formed by the inks discharged from the ink-jet recording heads 231 through 238 were observed for bleeding between the different colors and evaluated. Table 2 summarily shows the outcome of evaluation. In Table 2, bleeding was evaluated by the difference between the maximum value and the minimum value of surface tension. It was rated as good (o) when the difference is not greater than 2, as slightly bad (Δ) when the difference is 3 and as bad (x) when the difference is not smaller than 4.

TABLE 2

| Difference of ink surface tension (mN/m) | Bleeding |
|---|---|
| 0 | ○ |
| 2 | ○ |
| 3 | Δ |
| 4 | x |

Thus, the ink-jet printing apparatus according to the invention produced high quality images by using inks showing surface tensions as described above.

Therefore, when the surface tensions of inks discharged respectively from the ink-jet recording heads 231 through 238 are differentiated so as to fall in the mentioned order and the difference between the maximum value and the minimum value of surface tension of ink is made not greater than 3 mN/m, preferably not greater than 2 mN/m, the dots of the fixed inks can be made substantially equal to each other if the time periods from the time when inks are discharged from the ink-jet recording heads 231 through 238 to the time when they get to the UV-setting unit 23*a* fall in the mentioned order. Additionally, the adjacently located ink dots do not show any bleeding so that the image quality is stabilized.

While the ink-jet recording heads 231 through 234 were filled with black inks showing different surface tensions that fell in the descending order in the above described experiment, the ink-jet recording heads 231 through 234 may be filled with inks of different colors so long as the surface tensions of the inks are differentiated so as to fall in the descending order.

It is not necessary to discriminate the colors of inks that are filled respectively into the ink-jet recording heads 231 through 238 when the surface tensions of inks are low.

While UV inks were used in the above description of the embodiments, aqueous inks, oil inks or solvent inks may alternatively be used.

While the first embodiment comprises four ink-jet recording heads as ink-jet discharge units and the second embodiment comprises eight ink-jet recording heads as ink-jet discharge units, any number n (n=integer) of ink-jet recording heads may be used for an ink-jet printing apparatus if the number is not smaller than 2. The surface tensions of inks discharged from the 1st through n-th ink-jet recording heads are differentiated so as to fall in the mentioned order and the difference between the maximum value and the minimum value of surface tension of ink is made not greater than 3 mN/m, preferably not greater than 2 mN/m. With this arrangement, the dots of the fixed inks can be made substantially equal to each other if the time periods from the time when inks are discharged from the 1st through n-th ink-jet recording heads to the time when they get to the UV-setting unit fall in the mentioned order. Additionally, the adjacently located ink dots do not show any bleeding so that the image quality of the produced image is stabilized.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. An ink-jet printing apparatus comprising:

at least two ore more than two ink-jet recording heads provided with respective discharge ports for discharging ink and arranged in the direction of conveyance of a recording medium;

conveying means for conveying a recording medium; and a drive section which drives the ink-jet recording heads so as to discharge inks toward the recording medium being conveyed by the conveying means, wherein the inks discharged from the respective ink-jet recording heads are of a same type, and surface tensions of the inks discharged respectively from the two or more than two ink-jet recording heads decrease in an order of arrangement of the ink-jet recording heads in a direction of conveyance of the recording medium.

2. The apparatus according to claim 1, wherein a difference between a maximum value and a minimum value of the surface tension of the ink discharged from each of the ink-jet recording heads is not greater than 3 mN/m.

3. The apparatus according to claim 1, wherein a difference between a maximum value and a minimum value of the surface tension of the ink discharged from each of the ink-jet recording heads is not greater than 2 mN/m.

4. The apparatus according to claim 1, wherein the inks are set by an electromagnetic wave.

5. The apparatus according to claim 4, wherein the inks that are set by an electromagnetic wave are ultraviolet-setting type inks.

6. The apparatus according to claim 1, wherein the inks discharged from the respective ink-jet recording heads have different colors.

7. The apparatus according to claim 6, wherein a difference between a maximum value and a minimum value of the surface tension of the ink discharged from each of the ink-jet recording heads is not greater than 3 mN/m.

8. The apparatus according to claim 6, wherein a difference between a maximum value and a minimum value of the surface tension of the ink discharged from each of the ink-jet recording heads is not greater than 2 mN/m.

9. The apparatus according to claim 6, wherein the inks are set by an electromagnetic wave.

10. The apparatus according to claim 9, wherein the inks that are set by an electromagnetic wave are ultraviolet-setting type inks.

* * * * *